US006963316B1

(12) United States Patent
Lin

(10) Patent No.: US 6,963,316 B1
(45) Date of Patent: Nov. 8, 2005

(54) SATELLITE ANTENNA

(75) Inventor: Ming-Tien Lin, Nantou (TW)

(73) Assignee: Jonsa Technologies Co., Ltd., (CN)

( * ) Notice: Subject to any disclaimer, the term of this patent is extended or adjusted under 35 U.S.C. 154(b) by 0 days.

(21) Appl. No.: 10/873,808

(22) Filed: Jun. 22, 2004

(51) Int. Cl.[7] ..... H01Q 3/02
(52) U.S. Cl. ..... 343/882
(58) Field of Search ..... 343/882, DIG. 2, 343/878, 880

(56) References Cited

U.S. PATENT DOCUMENTS 6,445,361 B2 * 9/2002 Liu et al. ..... 343/882
6,630,912 B2 * 10/2003 Ehrenberg et al. ..... 343/882
6,762,731 B1 * 7/2004 Chou ..... 343/882
6,873,304 B1 * 3/2005 Malhotra ..... 343/890
2001/0045912 A1 * 11/2001 Li et al. ..... 343/882
2004/0196207 A1 * 10/2004 Schefter et al. ..... 343/878
2005/0057428 A1 * 3/2005 Fujita ..... 343/882

* cited by examiner

*Primary Examiner*—Hoang V. Nguyen
*Assistant Examiner*—Angela M Lie
(74) *Attorney, Agent, or Firm*—Jackson Walker, LLP

(57) ABSTRACT

A satellite antenna has an antenna, a stand assembly, an adjustable bracket, a mounting bracket, a dish-turning assembly, a dish-rotating assembly and a dish-pivoting assembly. The antenna is mounted on the mounting bracket. The mounting bracket rotates on the adjustable bracket. The adjustable bracket is mounted on the stand assembly and is positioned by the dish-turning assembly, dish-rotating assembly and dish-pivoting assembly.

2 Claims, 8 Drawing Sheets

SATELLITE ANTENNA

BACKGROUND OF THE INVENTION

1. Field of the Invention

The present invention relates to an antenna, and more particularly to a satellite antenna for receiving signals from satellites or other sources.

2. Description of Related Art

Satellite antennas are used in various fields that need data from and passed through satellites. For example, a site may need a satellite antenna to receive satellite images from a meteorological satellite to track clouds and storms. A television may also need a satellite antenna to receiver satellite TV programs.

A conventional satellite antenna comprises a stand and an adjustable antenna dish mounted on the stand. The antenna dish may be turned or rotated by hand to a direction to receive signals clearly from a satellite. However, adjusting the direction of the antenna dish manually can be imprecise.

To overcome the shortcomings, the present invention provides a satellite antenna to mitigate or obviate the aforementioned problems.

SUMMARY OF THE INVENTION

The main objective of the invention is to provide an improved satellite antenna that has a dish-turning assembly, two dish-rotating assemblies and a dish-pivoting assembly to very precisely point an antenna dish.

The satellite antenna in accordance with the present invention comprises an antenna, a stand assembly, an adjustable bracket, a mounting bracket, a dish-turning assembly, two dish-rotating assemblies and a dish-pivoting assembly. The antenna is mounted on the mounting bracket. The mounting bracket rotates on the adjustable bracket. The adjustable bracket is mounted on the stand assembly and is positioned by the dish-turning assembly, dish-rotating assemblies and dish-pivoting assembly.

Other objects, advantages and novel features of the invention will become more apparent from the following detailed description when taken in conjunction with the accompanying drawings.

DETAILED DESCRIPTION OF PREFERRED EMBODIMENT

Figure 1:
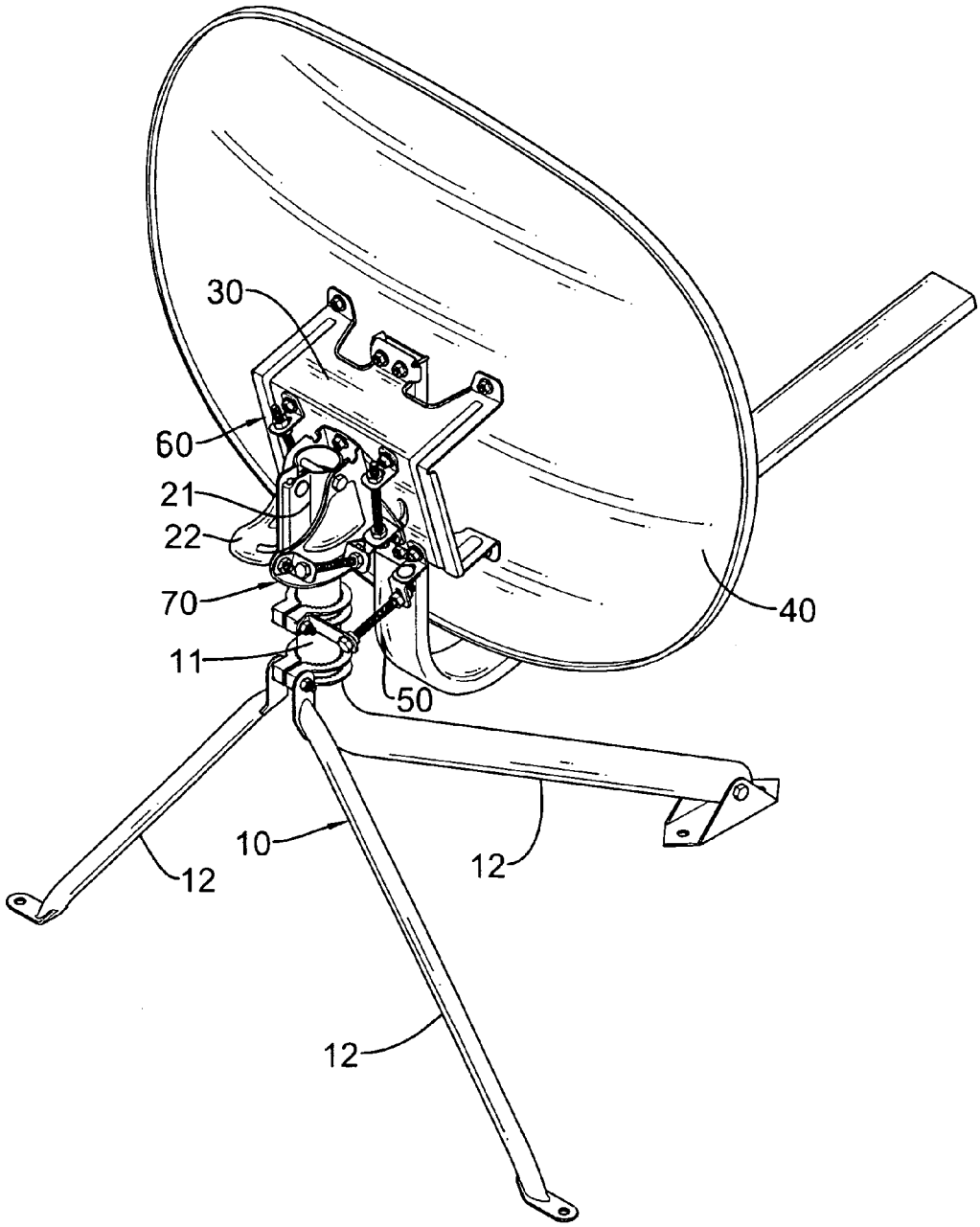
FIG. 1 is a perspective view of a satellite antenna in accordance with the present invention.
Figure 2:
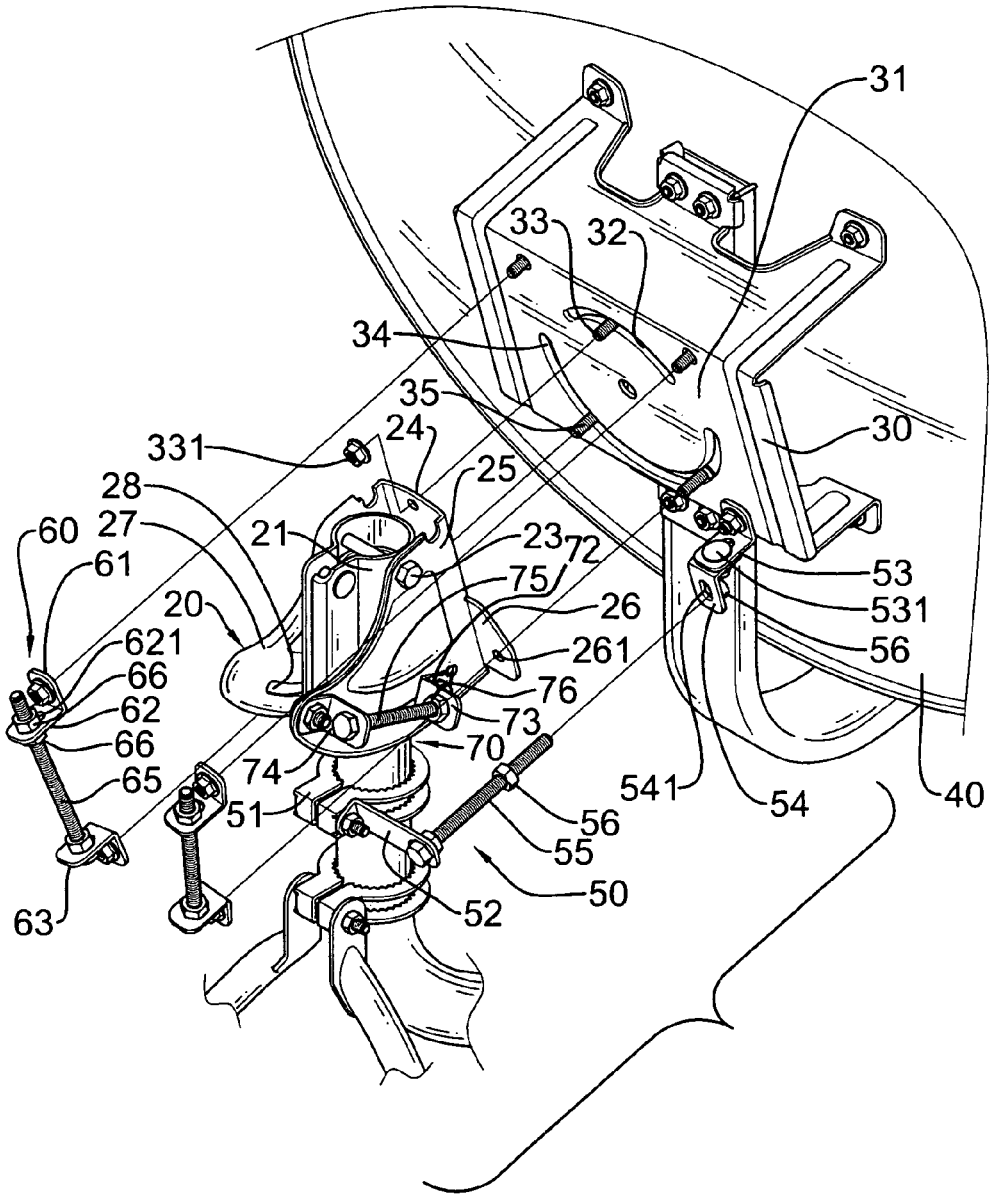
FIG. 2 is an exploded perspective view of the satellite antenna in FIG. 1.

With reference to FIGS. 1 and 2, the satellite antenna in accordance with the present invention comprises a stand assembly (10), an adjustable bracket (20), a mounting bracket (30), an antenna dish (40), a dish-turning assembly (50), two optional dish-rotating assemblies (60) and a dish-pivoting assembly (70).

The stand assembly (10) has a post (11) and at least three legs (12). The post (11) has a top end and a bottom end. The at least three legs (12) are attached to the bottom end of the post (11).

The adjustable bracket (20) is mounted rotatably on the post (11) and has a post bracket (21), a (22) pivot pin (23) and an elevation bracket (22). The post bracket (21) is mounted rotatably on the top end of the post (11) and has a top end and a bottom end.

The pivot pin (23) is mounted transversely through the post bracket (21) near the top end.

The elevation bracket (22) is mounted pivotally on the pivot pin (23), is U-shaped and has a cross face (24), two wings (25) and two optional mounting tabs (26). The cross face (24) has a top end, a front, a rear and two sides. The two wings (25) extend respectively from the sides of the cross face (24), are parallel to each other and are mounted pivotally on the pivot pin (23). Each wing (25) has a top end, a curved bottom edge, a tail (27) and a curved side slot (28). The top ends of the wings are penetrated by and pivot on the pivot pin (23). The tail (27) is formed on the wing (25) close to the curved bottom edge opposite from the cross face (24). The curved side slot (28) is defined through the wing (25) close to the curved bottom edge. The two optional mounting tabs (26) are formed respectively on and extend out from the sides of the cross face (24), and each has a front, a rear and a through hole (261). The through hole (261) is defined through the optional mounting tab (26).

The mounting bracket (30) is U-shaped, is mounted rotatably on the front of the cross face (24) of the elevation bracket (22) and has two sides, a cross member (31), an optional top slider (33) and two optional bottom sliders (35).

The cross member (31) has a top edge, a bottom edge, two side edges, an optional top curved slot (32) and an optional bottom curved slot (34). The cross member (31) is mounted rotatably on the cross face (24) of the elevation bracket (22). The optional top curved slot (32) is defined near the top edge of the cross member (31). The optional bottom curved slot (34) is defined near the bottom edge of the cross member (31) and is concentric with the optional top curved slot (32).

The optional top slider (33) is mounted slidably in the optional top curved slot (32), is attached to the top end of the cross face (24) of the elevation bracket (22) and has a bolt and a nut (331). The bolt has a distal end that passes through optional top curved slot (32) and the cross face (24). The nut (331) screws onto the distal end of the bolt to keep the cross face (24) and the cross member (31) from rotating.

The optional two bottom sliders (35) slide in the optional bottom curved slot (34) and pass respectively through the through holes (261) in the optional mounting tabs (26) on the sides of the cross face (24). Each of the optional two bottom sliders (35) has a distal end.

The antenna dish (40) receives signals from satellites or other sources and is attached to the sides of the mounting bracket (30).

The dish-turning assembly (50) precisely adjusts the antenna dish (40) bearing, is mounted on the post (11) and is attached to the cross member (31) of the mounting bracket (30). The dish-turning assembly (50) has a clamp (51), a clamp connector (52), a mounting bracket connector (53), a dish-turning bolt (55) and two dish-turning nuts (56). The clamp (51) is attached to the post (11) under the post bracket (21). The clamp connector (52) is attached to and extends out from the clamp (51).

The mounting bracket connector (53) is attached to the cross member (31) of the mounting bracket (30) and has a connector pin (531), an L-shaped mounting bracket tab and a dish-turning tab (54)). The L-shaped mounting bracket tab is attached to the cross member (31) and has a transverse tab and a longitudinal tab. The transverse tab is attached to the cross member (31) near the bottom edge and has a through hole (not shown). The longitudinal tab has a through hole through which the connector pin (531) passes. The dish-turning tab (54) is L-shaped, is connected rotatably to the mounting bracket connector (53) with the connector pin (531) and has a longitudinal tab and a transverse tab. The longitudinal tab of the dish-turning tab (54) is connected to rotatably to the longitudinal tab of the mounting bracket tab and has a through hole (not shown). The through hole of the longitudinal tab of the dish-turning tab (54) corresponds to the through hole in the longitudinal tab of the mounting bracket tab. The transverse tab of the dish-turning tab (54) has two sides and an elongated hole (541). The elongated through hole (541) is defined through the transverse tab of the dish-turning tab (54).

The dish-turning bolt (55) passes through the elongated through hole (541) that allows the dish-turning bolt (55) to move slightly inside the elongated through hole (541). The dish-turning bolt (55) is connected to the clamp connector (52) and has a proximal end and a distal end. The proximal end is connected to the clamp connector (52) and may be welded to the clamp connector (52), attached to the clamp connector (52) with a mounting nut or formed integrally with the clamp connector (52). The distal end passes through the elongated through hole (541) in the dish-turning tab (54) attached to the mounting bracket connector (53), which allows the dish-turning bolt (55) to move slightly inside the elongated through hole (54). The two dish-turning nuts (56) are mounted on the dish-turning bolt (55) respectively on the opposite sides of transverse tab of the dish-turning tab (54) attached to the mounting bracket connector (53).

The two optional dish-rotating assemblies (60) precisely rotate the antenna dish (40) in a plane parallel to the cross member (31) of the mounting bracket (30). Each of optional dish-rotating assemblies (60) has a top connector (61), a bottom connector (63), a dish-rotating bolt (65) and two dish-rotating nuts (66). The top connector (61) is attached rotatably to the cross member (31) of the mounting bracket (30) and has a dish-rotating tab (62) and an elongated through hole (621). The dish-rotating tab (62) has two sides. The elongated through hole (621) is defined through the dish-rotating tab (62). The bottom connectors (63) are rotatably attached respectively to the distal ends of the optional bottom sliders (35) on the mounting bracket (30) through the through holes (261) in the optional mounting tabs (26). The dish-rotating bolt (65) has a proximal end and a distal end. The proximal end is attached securely to the bottom connector (63), and the distal end passes through the elongated through hole (621) in the dish-rotating tab (62). The two dish-rotating nuts (66) are mounted on the dish-rotating bolt (65) respectively on opposite sides of the dish-rotating tab (62).

Figure 3:
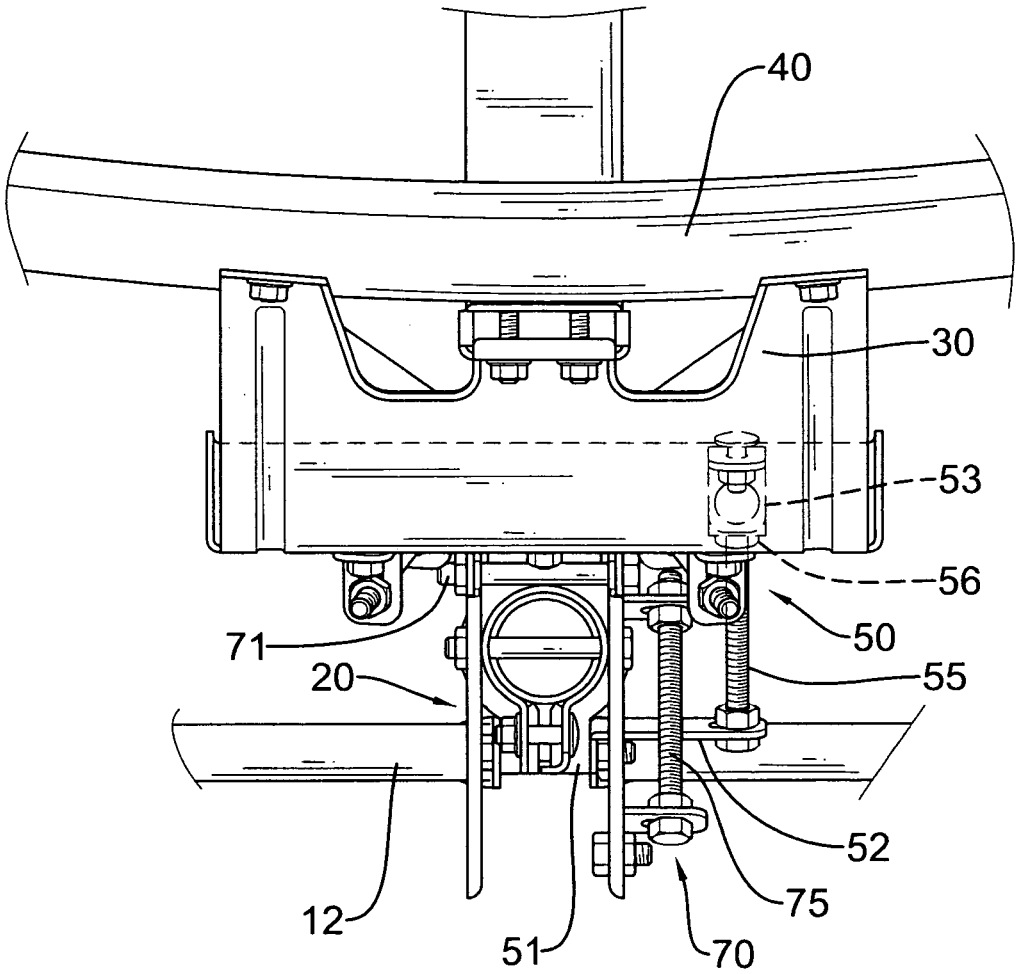
FIG. 3 is a top view of the satellite antenna in FIG. 1 with the antenna dish at an original position.
Figure 4:
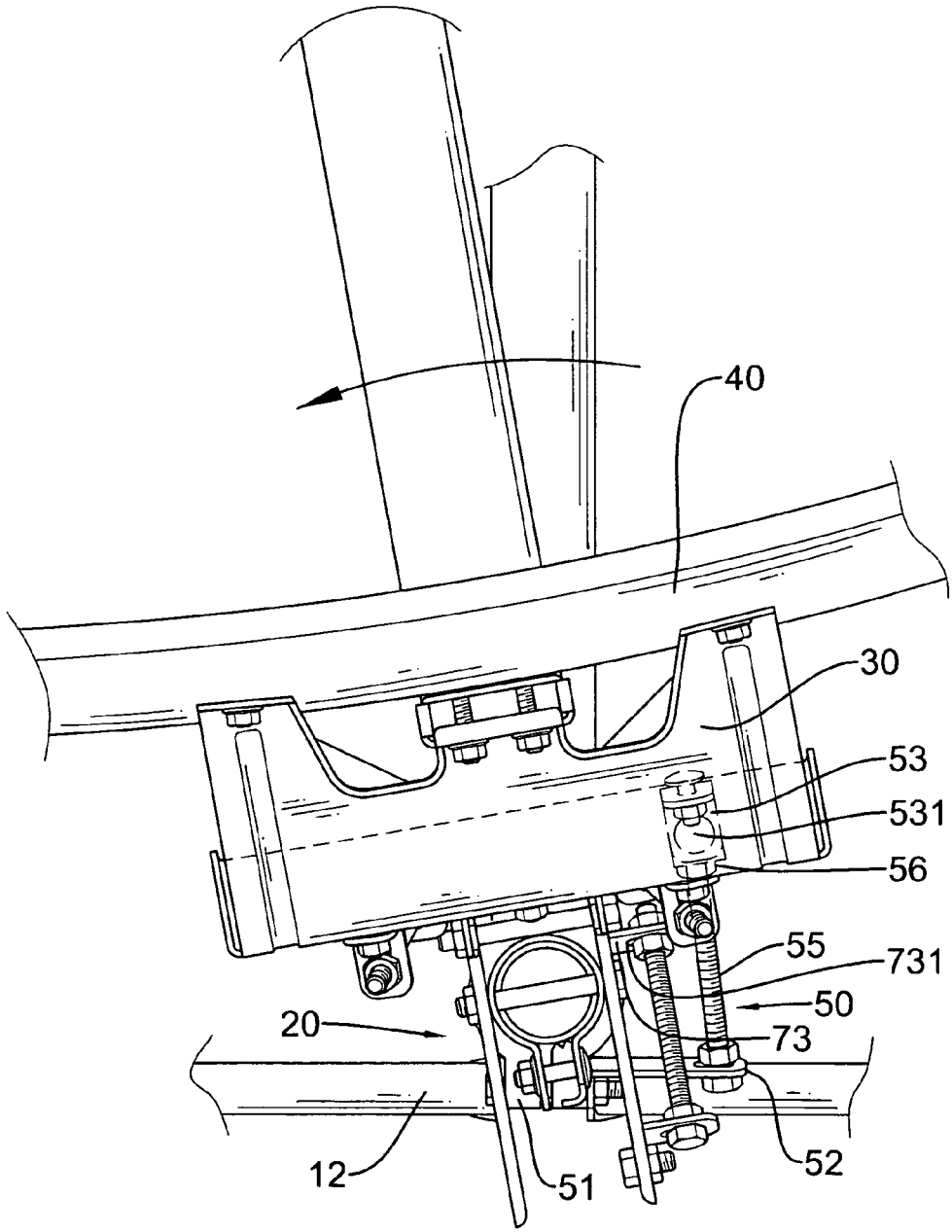
FIG. 4 is an operational top view of the satellite antenna in FIG. 1 with the antenna dish adjusted in bearing with the dish-turning assembly.
Figure 7:
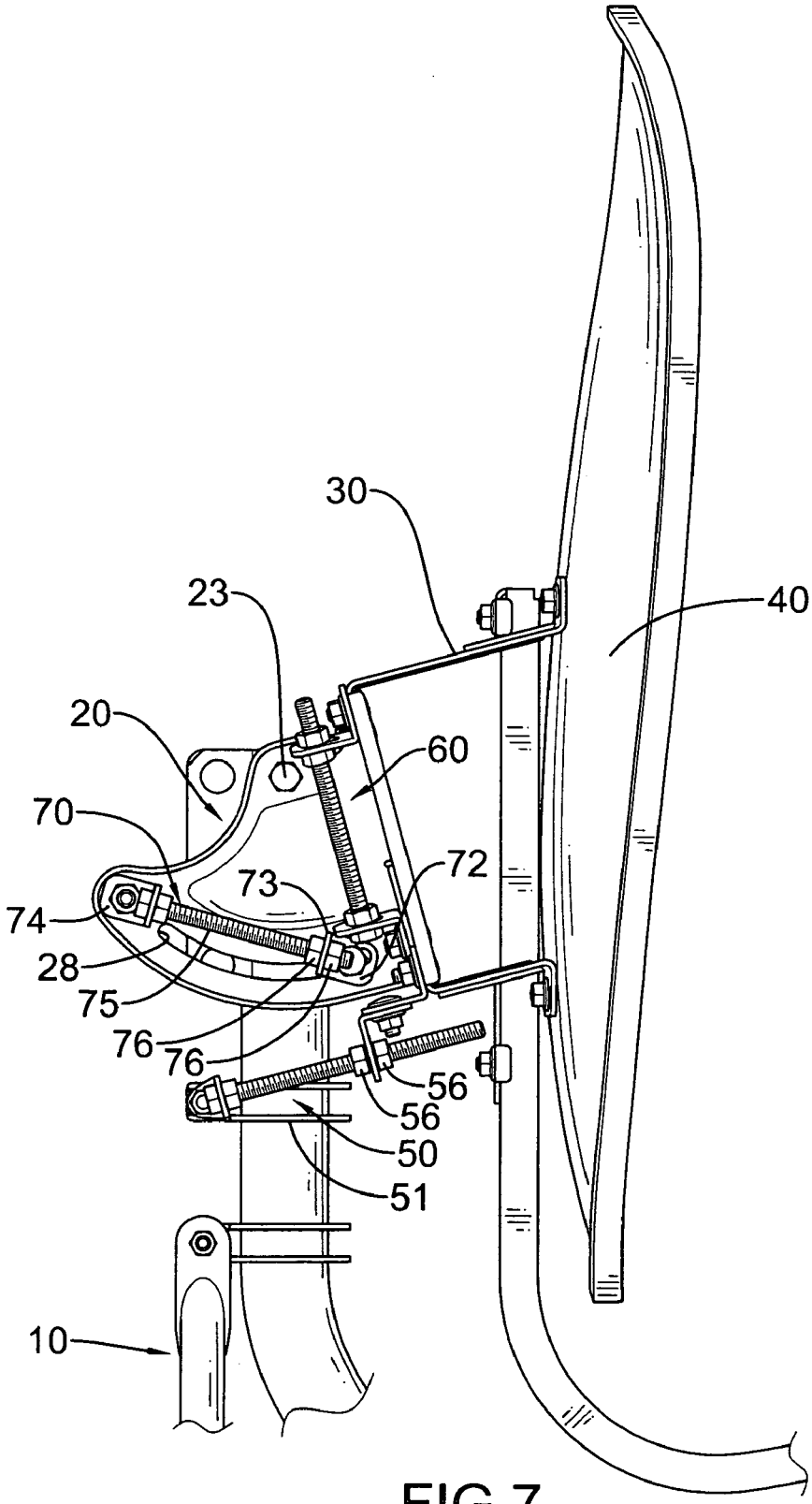
FIG. 7 is a side view of the satellite antenna in FIG. 1 with the antenna dish at the original position.

With further reference to FIGS. 3, 4 and 7, the dish-pivoting assembly (70) precisely pivots the antenna dish (40) to a desired elevation. The dish-pivoting assembly (70) is mounted on one of the wings (25) of the elevation bracket (22) and has a sliding rod (71), a rod connector (72), tail connector (74), a dish-pivoting bolt (75) and two dish-pivoting nuts (76). The sliding rod (71) passes through and is mounted slidably inside the curved side slots (28) in the wings (25) of the elevation bracket (22) and abuts the post bracket (21). The rod connector (72) holds the sliding rod (71) outside the corresponding wing (25) of the elevation bracket (22) and has a dish-pivoting tab (73) and a through hole (731). The dish-pivoting tab (73) has two sides. The through hole (731) in the rod connector (72) is defined through the dish-pivoting tab (73). The tail connector (74) is attached to the tail (27) of the corresponding wing (25). The dish-pivoting bolt (75) is mounted between the rod connector (72) and the tail connector (74), has a proximal end and a distal end. The proximal end is attached securely to the tail connector (74), and the distal end passes through the through hole (731) in the rod connector (72). The two dish-pivoting nuts (76) are mounted on the dish-pivoting bolt (75) respectively on opposite sides of the dish-pivoting tab (73).

With reference FIGS. 3 and 4, the dish-turning assembly (50) turns the antenna dish (40) by rotating the dish-turning nuts (56) and moving the dish-turning tab (54) on the mounting bracket connector (53). To turn the antenna dish (40) to the right, the dish-turning nut (56) closest to the clamp connector (52) is screwed onto the dish-turning bolt (55) and moved toward the clamp connector (52) until the antenna dish (40) is turned to a desired bearing. Then the other dish-turning nut (56) is screwed onto the dish-turning bolt (55) until the dish-turning tab (54) is squeezed between the two dish-turning bolts (55). The mounting bracket (30) is pulled by the dish-turning tab (54) to make the post bracket (21) rotate right or left on the post (11) and the antenna dish (40) on the mounting bracket (30) turns right. To turn the antenna dish (40) to the left the dish-turning nut farthest from the clamp connector (52) is screwed toward the distal end of the dish-turning bolt (55) first and the remainder of the sequence is performed in reverse until the antenna dish (40) is held at the desired bearing.

Figure 5:
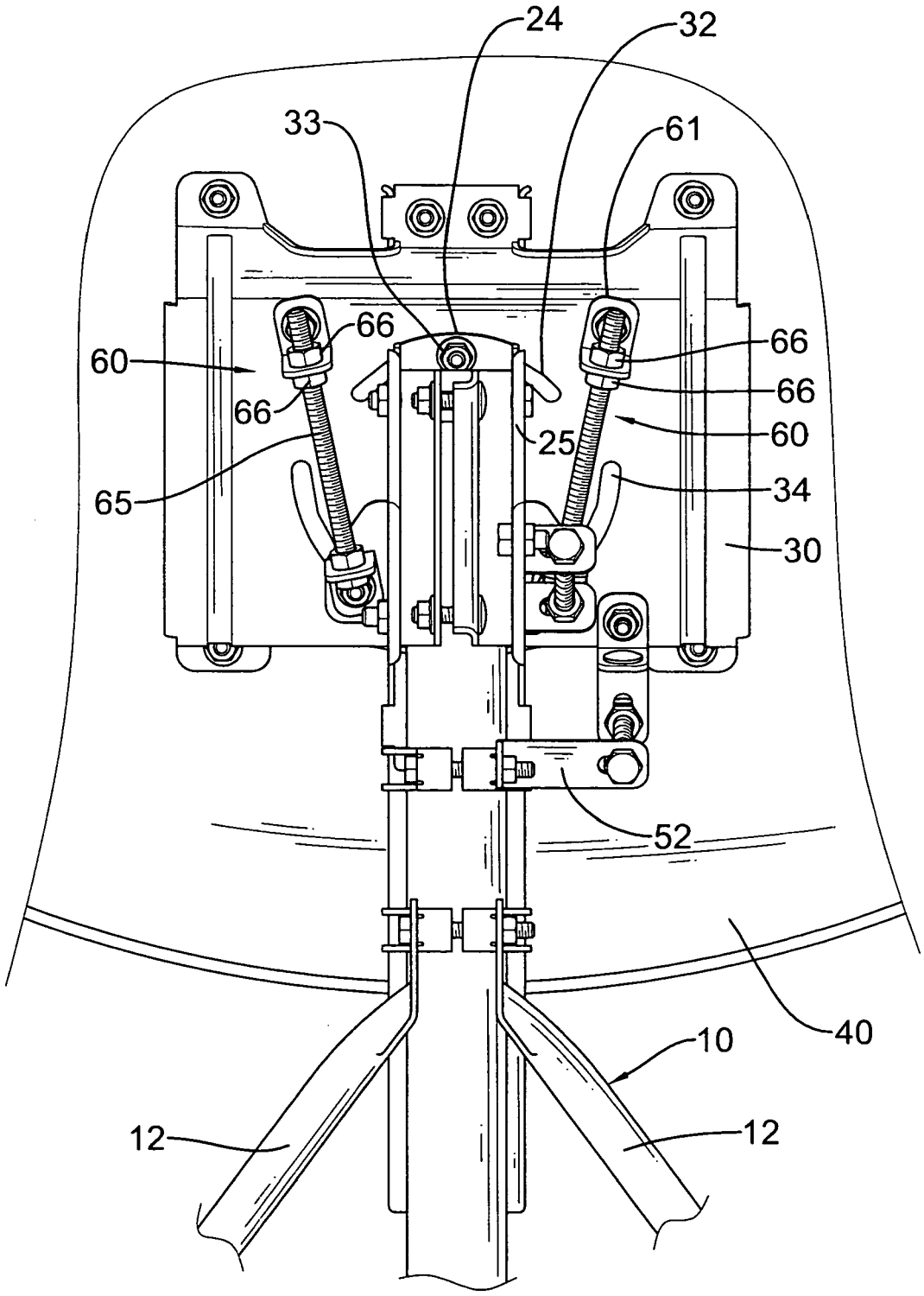
FIG. 5 is a rear view of the satellite antenna in FIG. 1 with the antenna dish at the original position.
Figure 6:
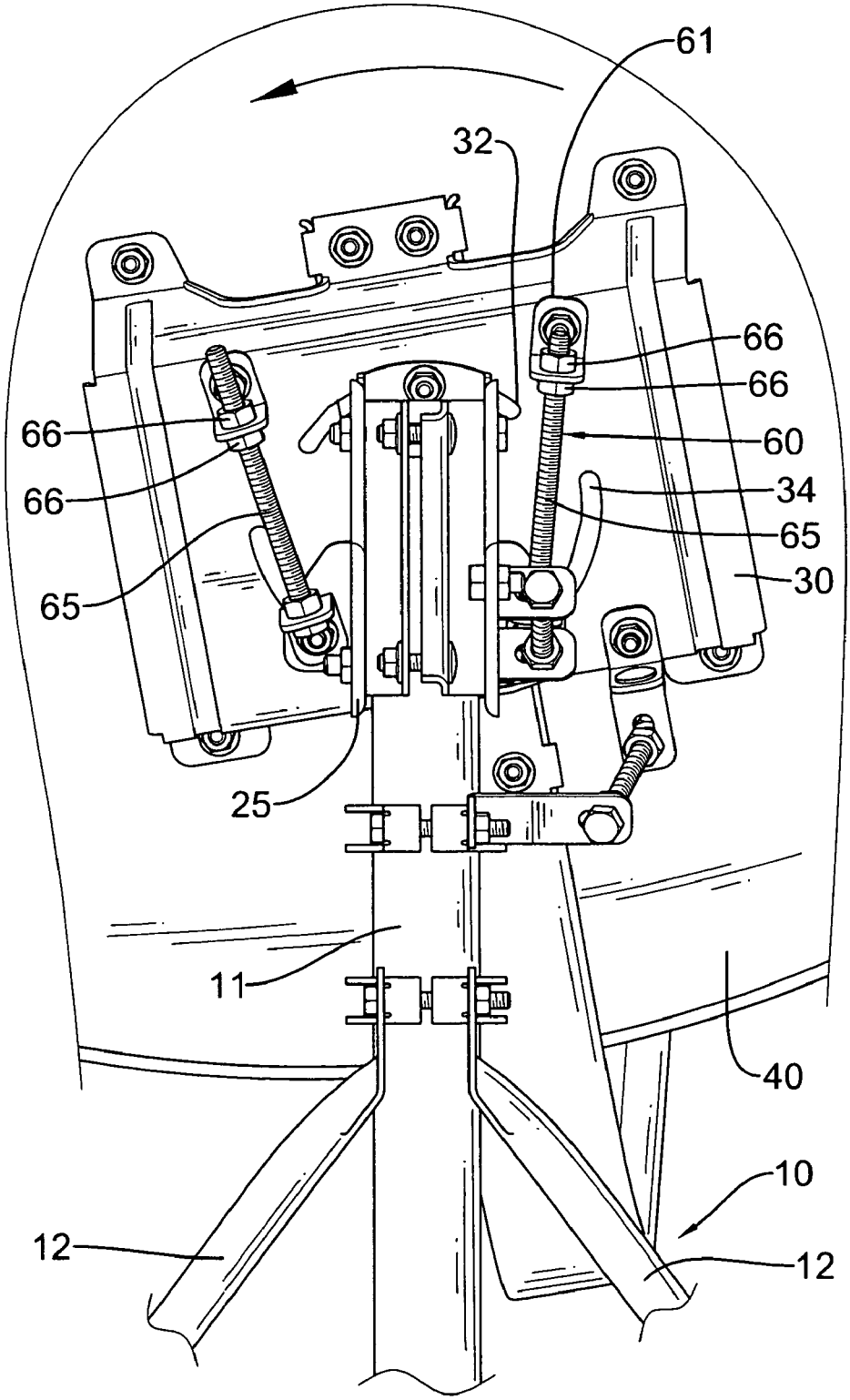
FIG. 6 is an operational rear view of the satellite antenna in FIG. 5 with the antenna dish rotated by the dish-rotating assembly.

With reference FIGS. 5 and 6, the optional dish-rotating assemblies (60) adjust the orientation of the antenna dish (40) in a face plane parallel to the plane of the cross member (31) The orientation of the antenna dish (40) is adjusted by adjusting the optional dish-rotating assemblies (60). To rotate the antenna dish (40) counterclockwise, the dish-rotating nuts (66) respectively on the dish-rotating bolts (65) are adjusted. The nut (331) attached to the optional top slider (33) is loosed to allow the cross member (31) to rotate. The lower dish-rotating nut (66) on the dish-rotating bolt (65) close to the left side edge of the cross member (31) is rotated, moves toward the bottom connector (63) and is positioned to a desire position on the dish-rotating bolt (65). The upper dish-rotating nut (66) on the dish-rotating bolt (65) close to the left side edge of the cross member (31) is rotated and moves the dish-rotating tab (62) on the top connector (61) toward the positioned dish-rotating nut (66). The upper dish-rotating nut (66) on the dish-rotating bolt (65) close to the right side edge of the cross member (31) is rotated, moves toward the distal end of the dish-rotating bolt (65) and is positioned to a desire position. The lower dish-rotating nut (66) on the dish-rotating bolt (65) close to the right side edge of the cross member (31) is rotated and moves the dish-rotating tab (62) on the top connector (61) toward the positioned dish-rotating nut (66). The mounting bracket (30) is pulled or pushed by the top connector (61) to rotate and simultaneously the optional top slider (33) slides inside the optional top curved slot (32) and the optional bottom sliders (35) slide inside the optional bottom curved slot (34). When the rotating dish-rotating nuts (66) respectively moves the dish-rotating tabs (62) against the positioned dish-rotating nuts (66), the antenna dish (40) with the mounting bracket (30) rotates to a preferred angle for clear signals.

Figure 8:
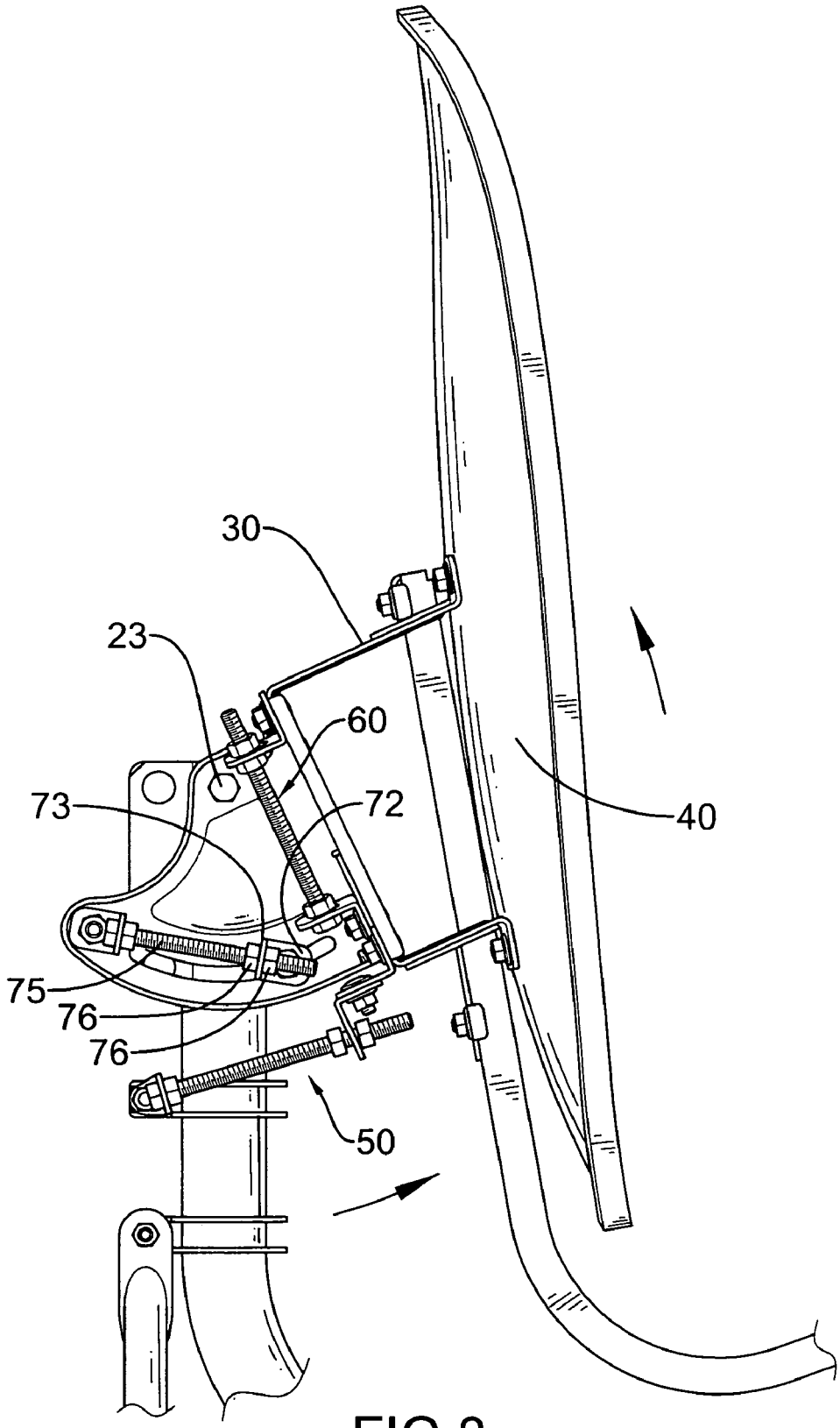
FIG. 8 is an operational rear view of the satellite antenna in FIG. 7 with the antenna dish adjusted in elevation by the dish-pivoting assembly.

With reference FIGS. 7 and 8, the dish-pivoting assembly (70) adjusts elevation of the antenna dish (40) by turning the dish-pivoting nuts (76) away from and releasing the dish-pivoting tab (73) on the rod connector (72). The dish-turning nuts (56) rotate away from and loose the dish-turning tab (54) for the dish-turning bolt (55) swinging slight inside the elongated through hole (541). One of the dish-pivoting nut (76) rotates, moves toward the tail connector (74) or toward the distal end of the dish-pivoting bolt (75) and is positioned to a desire position on the dish-pivoting bolt (75). The other dish-pivoting nut (76) keep rotating and moves the dish-pivoting tab (73) on the dish-pivoting bolt (75) toward the dish-pivoting nuts (76). The sliding rod (71) slides inside the curved side slot (28) and the bottom edges of the wings (25) swing. The elevation bracket (22) depends on a distance between the tail connector (74) and the sliding rod (71) and pivots on the pivot pin (23). When the rotating dish-pivoting nut (76) moves the dish-pivoting tab (73) against the positioned dish-pivoting nut (76), the antenna dish (40) with the elevation bracket (22) pivots to a preferred angle of elevation for clear signals or air waves.

The dish-turning assembly (50) can precisely regulate the turn of the antenna dish (40). The optional dish-rotating assemblies (60) can precisely regulate the rotation of the antenna dish (40). The dish-pivoting assembly (70) can precisely regulate the angle of elevation of the antenna dish (40). The satellite antenna of the invention is able to receive accurately signals from satellites or other air waves.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A satellite antenna comprising:

a stand assembly having a post having a top end and a bottom end; and at least three legs mounted on the bottom end of the post;

an adjustable bracket mounted on the post of the stand assembly and having a post bracket rotatably mounted on the top end of the post and having a top end and a bottom end;

a pivot pin mounted on the top end of the post bracket; and an elevation bracket surrounding on the top end of the post bracket, pivoting vertically on the pivot pin and having a cross face having a top end, a front, a rear and two sides; and two wings extending respectively from the sides of the cross face, parallel to each other, pivotally mounted on the pivot, each having a top end penetrated horizontally by the pivot;

a curved bottom edge;

a tail defined on the wing close to the curved bottom edge opposite from the cross face; and a curved side slot defined through the wing close to the curved bottom edge;

a mounting bracket rotatably mounted on the front of the cross face of the elevation bracket of the adjustable bracket, having a cross member rotatably mounted on the cross face, having a top end and a bottom end;

an antenna dish mounted on the mounting bracket;

a dish-turning assembly mounted on the post of the stand assembly and the cross member of the mounting bracket, having a clamp mounted on the post under the post bracket;

a clamp connector mounted on the clamp;

a mounting bracket connector mounted on the cross member of the mounting bracket, having a connector pin;

an L-shaped mounting bracket tab attached to the cross member and having a transverse tab attached to the cross member near the bottom edge and having a through hole; and a longitudinal tab having a through hole through which the connector pin passes;

an L-shaped dish-turning tab connected rotatably to the mounting bracket tab with the connector pin, having a longitudinal tab connected rotatably to the longitudinal tab of the mounting bracket tab and having a through corresponding to the through hole of in the longitudinal tab of the mounting bracket tab; and a transverse tab having two sides and a elongated through hole defined through the transverse tab of the dish-turning tab;

a dish-turning bolt fixed on the clamp connector, having a proximal end connected to the clamp connector; and a distal end passing through the through hole of the mounting bracket connector; and two dish-turning nuts mounted on the dish-turning bolt respectively on the opposite sides of the dish-turning tab of the mounting bracket connector; and a dish-pivoting assembly mounted on and corresponding to one of the wings of the elevation bracket and having a sliding rod passing through and slidably mounted inside the curved side slots in the wings of the elevation bracket and abutting against the post bracket;

a rod connector engaged with the sliding rod outside the corresponding wing of the elevation bracket and having a dish-pivoting tab having two sides; and a through hole defined through the dish-pivoting tab;

a tail connector mounted on the tail of the corresponding wing;

a dish-pivoting bolt fixed on the tail connector, having a proximal end attached securely to the tail connector; and a distal end passing through the through hole of the rod connector; and two dish-pivoting nuts mounted on the dish-pivoting bolt respectively on the opposite sides of the dish-pivoting tab.

2. The satellite antenna as claimed in claim 1, wherein the elevation bracket further comprises two mounting tabs defined respectively on the sides of the cross face, each having a front;

a rear; and a through hole defined through the mounting tab;

the mounting bracket further comprises a top curved slot defined through the top end of the cross member;

a top slider slidably mounted on the top curved slot and engaged with the top end of the cross face, having a distal end passing through top end of the cross face; and a top nut mounted on the distal end of the top slider adjacent the rear of the cross face;

a bottom curved slot defined through the bottom end of the cross member and in concentric circles together with the top curved slot; and two bottom sliders slidably mounted on the bottom curved slot, passing through the through hole of the mounting tabs respectively on the sides of the cross face, each having a distal end; and two dish-rotating assemblies mounted on the mounting bracket, corresponding respectively to the bottom sliders and the mounting tabs, each having a top connector rotatably mounted on the cross member of the mounting bracket, having a dish-rotating tab having two sides; and a through hole defined through the dish-rotating tab;

a bottom connector rotatably mounted on the distal end of the corresponding bottom slider of the mounting bracket adjacent the rear of the corresponding mounting tab; and a dish-rotating bolt fixed on the bottom connector and having a proximal end attached securely to the bottom connector; and a distal end passing through the through hole of the top connector; and two dish-rotating nuts mounted on the dish-rotating bolt respectively on the opposite sides of the dish-rotating tab.

* * * * *